US005265867A

United States Patent [19]

Magee

[11] Patent Number: 5,265,867

[45] Date of Patent: Nov. 30, 1993

[54] SIGNATURE CONVEYOR WITH DIVERGING BELTS AND BEVELED EDGE SUPPORT

[75] Inventor: Lawrence D. Magee, Bollingbrook, Ill.

[73] Assignee: R. R. Donnelley & Sons Co., Lisle, Ill.

[21] Appl. No.: 880,675

[22] Filed: May 8, 1992

[51] Int. Cl.[5] ..... B65H 5/02; B65H 29/70

[52] U.S. Cl. ..... 271/272; 271/188; 101/232

[58] Field of Search ..... 270/1.1; 271/161, 188, 271/198, 272, 275; 101/232

[56] References Cited

U.S. PATENT DOCUMENTS

| | | | |
|---|---|---|---|
| 2,664,731 | 1/1954 | Griffin | 271/198 X |
| 2,846,052 | 8/1958 | Heinemann et al. . | |
| 3,134,183 | 5/1964 | Duflot . | |
| 3,198,516 | 8/1965 | Withorn et al. . | |
| 3,779,543 | 12/1973 | Hayes | 271/198 X |
| 3,860,232 | 1/1975 | Martin | 271/198 |
| 3,907,284 | 9/1975 | Fritz . | |
| 3,934,872 | 1/1976 | Honkawa . | |
| 3,954,261 | 5/1976 | Greene et al. . | |
| 4,009,877 | 3/1977 | Ward, Jr. . | |
| 4,620,807 | 11/1986 | Polit . | |
| 5,130,754 | 7/1992 | Hishikawa | 271/272 X |
| 5,133,543 | 7/1992 | Eitel et al. | 271/276 |
| 5,165,676 | 11/1992 | Blessing et al. | 271/198 X |
| 5,178,379 | 1/1993 | Edwards et al. | 271/198 X |

FOREIGN PATENT DOCUMENTS

| | | | |
|---|---|---|---|
| 509009 | 10/1930 | Fed. Rep. of Germany | 271/198 |
| 52341 | 5/1981 | Japan | 271/272 |
| 178146 | 9/1985 | Japan | 271/272 |
| 211267 | 9/1986 | Japan | 271/272 |
| 291344 | 12/1986 | Japan | 271/272 |

*Primary Examiner*—Edward K. Look
*Assistant Examiner*—John Ryznic
*Attorney, Agent, or Firm*—Wood, Phillips, VanSanten, Hoffman & Ertel

[57] ABSTRACT

In order to spread and flatten a signature for printing, and to hold the signature to prevent it from shifting, a binding line mail table includes a plate for supporting the signature in a flat orientation as the signature moves along the signature supporting plate. It also includes a first pair of drive belts disposed on the signature supporting plate in spaced apart relation and a second pair of drive belts disposed on the respective ones of the first pair of drive belts on the sides thereof opposite the signature supporting plate and, further, the drive belts are all then driven at substantially the same speed. With this unique arrangement, and to ensure that the signature is in a flat orientation as it moves along the signature supporting plate for printing thereon, at least one of the drive belts of one of the pairs diverges relative to the respective one of the drive belts of the other of the pairs.

16 Claims, 1 Drawing Sheet

SIGNATURE CONVEYOR WITH DIVERGING BELTS AND BEVELED EDGE SUPPORT

FIELD OF THE INVENTION

The present invention is generally directed to binding lines and, more particularly, a mail table for flat signature orientation on a binding line.

BACKGROUND OF THE INVENTION

In recent years, it is known that there have been a number of important advancements that relate to the operation of binding lines. These advancements have not only typically increased the overall efficiency and quality of binding line operations but have also given flexibility to offer capabilities that were unheard of just a few years ago. In this connection, there has been a great recognition of the considerable desirability of individually printing on signatures.

To this end, there are a number of commonly owned patents that represent the significant advancements that have been made in this field. Among these are Riley et al. U.S. Pat. No. 4,121,818, issued Oct. 24, 1978; Auksi U.S. Pat. No. 5,005,815, issued Apr. 9, 1991; and Mayer et al. U.S. Pat. No. 5,080,337, issued Jan. 14, 1992. While these constitute significant advancements, there is yet another area where printing signatures is known to be highly desirable.

In particular, it is known that it is sometimes desirable to print on a signature as it is being moved on a binding line mail table. However, there are also certain known requirements that must be met in order to be able to do this in a commercially acceptable manner. In order to obtain the quality that is required in such printing, the signature being imaged by ink jet must be delivered in a flat condition.

In other words, high quality ink jet imaging requires a signature to be in a very nearly flat orientation as it is being printed. This must be accomplished as the signature is delivered under the ink jet head in order to achieve the quality of printing that is commercially required. Still additionally, the signature must also be prevented from shifting while it is being imaged by the ink jet head as it moves on the mail table.

The present invention is directed to overcoming one or more of the foregoing problems and achieving one or more of the resulting objects.

SUMMARY OF THE INVENTION

It is therefore a principal object of the present invention to provide an improved binding line mail table. It is a further object of the present invention to provide such a mail table in which a signature can be delivered for printing in as flat a condition as possible as it moves along the mail table. It is an additional object of the present invention to prevent a signature from shifting as it is being imaged or printed.

Accordingly, the present invention is directed to a binding line mail table which has a plate for supporting a signature in a generally flat orientation as the signature moves along the signature supporting plate. A first pair of drive belts is disposed on the signature supporting plate and extend generally in the direction of travel of said signature in spaced apart relation and a second pair of drive belts is disposed on the respective ones of the first pair of drive belts and extend generally in the direction of travel of said signature on the sides opposite the signature supporting plate. The mail table also includes means for driving the drive belts at the same speed for moving the signature along a signature supporting plate. At least one of the drive belts of one of the pairs diverges relative to the respective one of the drive belts of the other of the pairs as well as relative to the direction of travel of said signature so as to insure that the signature is in the flat orientation as it moves along the signature supporting plate. With this arrangement, the binding line mail table also preferably includes means for printing on the signature as it is moved along the signature supporting plate by the first and second pairs of drive belts.

In one embodiment, the signature supporting plate is generally planar and has opposed generally parallel outwardly and downwardly beveled edges. The first pair of drive belts in this embodiment is such that the belts are preferably generally flat in transverse cross-section, are disposed in generally parallel relation at opposite edges of the signature supporting plate, and are adapted to be driven on the beveled edges thereof. In another embodiment, the signature supporting plate is a generally planar surface with the first pair of drive belts at opposite edges thereof.

In a highly exemplary embodiment, the first pair of drive belts are generally parallel lower belts and the second pair of drive belts are diverging upper belts. It is also advantageous, particularly with the first pair of drive belts being generally flat in transverse cross-section, for the second pair of drive belts to be generally round in transverse cross-section. In addition, the first and second pairs of drive belts are preferably spaced apart at a signature entry end of the first and second pairs of drive belts.

As previously suggested, the binding line mail table includes means for printing on the signature as the signature is moved by the drive belts along the signature supporting plate. It is contemplated in this respect that the signature is advantageously moved relative to the signature printing means in a generally linear path along the signature supporting plate. In this manner, and because the signature will be in a generally flat orientation, the signature printing means can print on the signature in a manner that it highly commercially desirable.

Other objects, advantages and features of the present invention will become apparent from a consideration of the following specification taken in conjunction with the accompanying drawings.

DETAILED DESCRIPTION OF THE PREFERRED EMBODIMENTS

Figure 1:
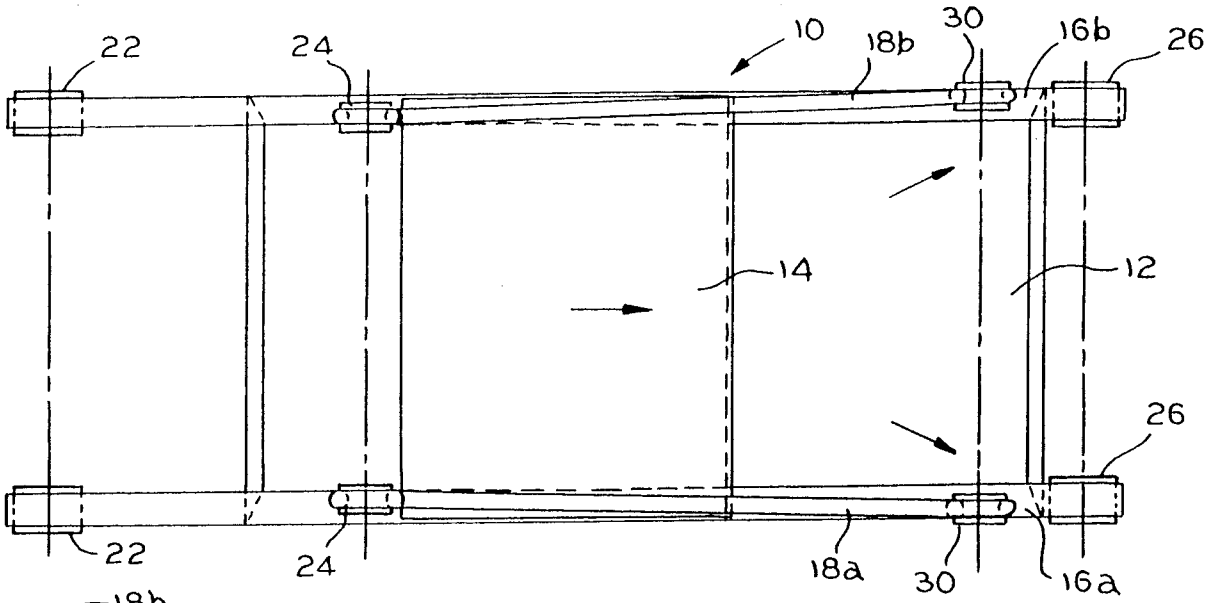
FIG. 1 is a top plan view of a binding line mail table in accordance with the present invention.
Figure 2:
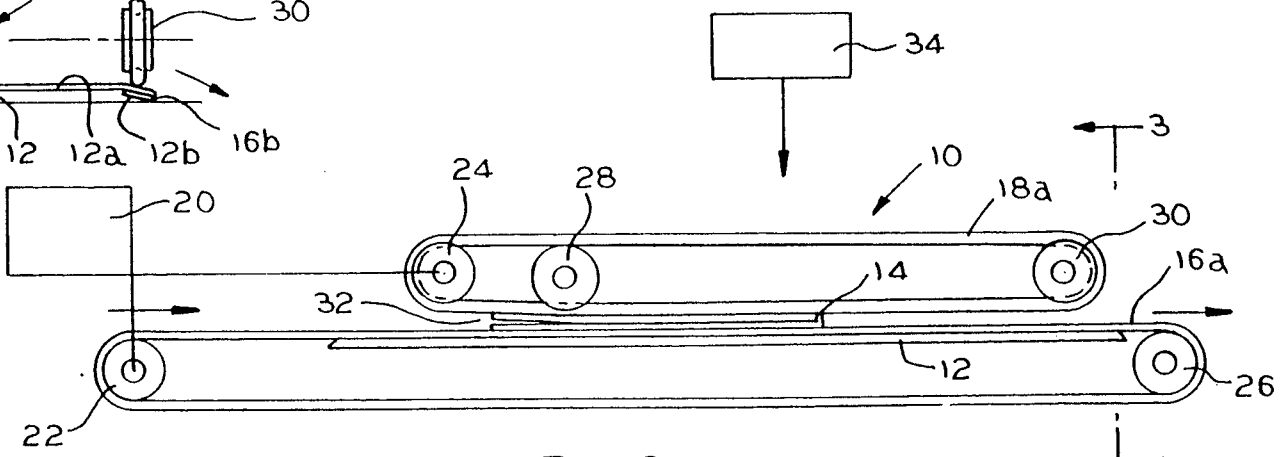
FIG. 2 is a front elevational view of the binding line mail table of FIG. 1.

In the illustrations given, and with reference first to FIG. 1, the reference numeral 10 designates generally a binding line mail table in accordance with the present invention. The binding line mail table 10 includes a plate 12 for supporting a signature 14 in a generally flat orientation as the signature 14 moves along the signature supporting plate 12 (see, also, FIG. 2). A first pair of drive belts 16*a* and 16*b* are disposed on the signature supporting plate 12 and extend generally in the direction of travel of said signature in spaced apart relation and a second pair of drive belts 18*a* and 18*b* are disposed on the respective ones of the first pair of drive belts 16*a* and 16*b* and extend generally in the direction of travel of said signature on the sides opposite the signature supporting plate. The binding line mail table 10 further includes means for driving the drive belts 16*a*, 16*b* and 18*a*, 18*b* at the same speed for moving the signature 14 along the signature supporting plate 12 (see, also, FIG. 2). As shown in FIG. 2, the driving means may include a conventional motor 20 operatively connected to drive pulleys 22 and drive pulleys 24 in a manner that will be known to those skilled in the art.

As shown in FIG. 2, the drive pulleys 22 are operatively associated with the drive belts 16*a* and 16*b* whereas the drive pulleys 24 are operatively associated with the drive belts 18*a* and 18*b*. It will also be appreciated that the respective pairs of drive belts 16*a*, 16*b* and 18*a*, 18*b* will also be trained about other pulleys such as 26 in the case of drive belts 16*a*, 16*b* and 28 and 30 in the case of drive belts 18*a* and 18*b*. As will be appreciated, these particular arrangements have been shown solely for purposes of illustrating the concept in one particular embodiment, not for purposes of limiting the scope of the invention.

Referring specifically to FIG. 1, it will be seen that at least one of the drive belts of one of the pairs diverges relative to the respective one of the drive belts of the other of the pairs as well as relative to the direction of travel of the signature. This is done in order to ensure that the signature 14 is in the desired generally flat orientation as it moves along the signature supporting plate 12. In the illustrated embodiment, the first pair of drive belts 16*a* and 16*b* are generally parallel lower belts and the second pair of drive belts 18*a* and 18*b* are both diverging upper belts.

In other words, it will be appreciated by referring to FIG. 1 that the first pair of drive belts 16*a*, 16*b* are generally parallel to one another with the second pair of drive belts 18*a*, 18*b* extending along but diverging relative to the first pair of drive belts 16*a*, 16*b* to cause the signature 14 to spread in order to remove any wrinkles while holding the signature solidly in a manner preventing it from shifting due to its edges being captured between the drive belts 16*a*, 16*b* and 18*a*, 18*b*.

Figure 3:
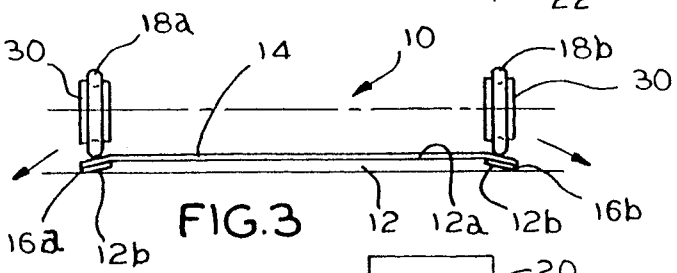
FIG. 3 is a cross-sectional view of the binding line mail table taken on the line 3—3 of FIG. 2.

Referring to FIG. 3, it will be seen that the signature supporting plate 12 is generally planar, i.e., it has a generally planar surface 12*a* for supporting the signature 14. In the illustrated embodiment, and as shown in FIG. 3, the signature supporting plate 12 has what may be described as opposed generally parallel outwardly and downwardly beveled edges 12*b*. With or without such beveled edges, the first pair of drive belts 16*a* and 16*b* are preferably disposed substantially at opposite edges of the signature supporting plate 12.

More specifically, the entire top surface 12*a* of the signature supporting plate 12 can be flat, i.e., co-planar, particularly for applications involving the running of a heavy or thick signature.

Referring to FIGS. 1–3, the first pair of drive belts 16*a* and 16*b* are generally flat and the second pair of drive belts 18*a* and 18*b* are generally round in transverse cross-section. It will also be seen that the first and second pairs of drive belts 16*a*, 16*b* and 18*a*, 18*b* are spaced apart at a signature entry end to define a signature entry guide 32 at and between the drive belts 16*a*, 16*b* and 18*a*, 18*b*. In other words, as a signature 14 approaches the mail table 10, the signature entry guide 32 directs the signature 14 between the first and second pairs of drive belts 16*a*, 16*b* and 18*a*, 18*b*.

As best shown in FIG. 3, the first pair of drive belts 16*a*, 16*b* are adapted to be driven on the beveled edges 12*b* of the signature supporting plate 12 and the round upper belts 18*a* and 18*b* track over the flat lower belts 16*a*, 16*b* with the signature 14 being fed between the belts. The round upper belts 18*a* and 18*b* diverge so as to cause the signature 14 to spread while the sides of the signature 14 are forced downwards to follow the beveled edges 12*b* of the signature supporting plate 12 whereby the combined action of these features removes any wrinkles in the signature 14 while holding the signature 14 solidly between the belts 16*a*, 16*b* and 18*a*, 18*b* so as to prevent it from shifting as it passes under means for printing on the signature 14 such as a conventional ink jet imaging device 34. As shown in the drawings, the ink jet imaging device 34 is arranged so as to print on the signature 14 as it is moved by the drive belts 16*a*, 16*b* along the signature supporting plate 12 in what may be described as a generally linear signature travel path for the signature.

As previously suggested, an entirely flat signature supporting plate could be used for applications which require the running of a heavy signature. The belts 16*a*, 16*b* and 18*a*, 18*b* then maintain the signature against shifting as it is moved along the signature supporting plate. However, by utilizing beveled edges, the opposite sides of a thin signature can be forced downwards to cause spreading of the signature.

If a magazine is to be fed head or foot first, one of the belts 18*a* and 18*b* can be straight, i.e., in the direction of travel of the magazine. In other words, and as will be appreciated, one of the belts 18*a* and 18*b* can extend generally parallel to the respective one of the other pair of belts 16*a* and 16*b*. However, in this arrangement, the other of the belts 18*a* and 18*b* can diverge to hold one side solidly while spreading the other side of the magazine.

While in the foregoing there have been set forth preferred embodiments of the invention, it will be appreciated that the details herein given may be varied by those skilled in the art without departing from the true spirit and scope of the appended claims.

I claim:

1. A binding line mail table, comprising:

a plate for supporting a signature in a generally flat orientation as said signature moves along said signature supporting plate;

a first pair of drive belts disposed on said signature supporting plate and extending generally in the direction of travel of said signature in spaced apart relation and a second pair of drive belts disposed on the respective ones of said first pair of drive belts and extending generally in the direction of travel of said signature on the sides opposite said signature supporting plate;

means for driving said drive belts at the same speed for moving said signature along said signature supporting plate;

at least one of said drive belts of one of said pairs diverging relative to the respective one of said drive belts of the other of said pairs as well as relative to the direction of travel of said signature so as to ensure that said signature is in said generally flat orientation as it moves along said signature supporting plate.

2. The binding line mail table of claim 1 wherein said signature supporting plate is generally planar and has opposed generally parallel outwardly and downwardly beveled edges.

3. The binding line mail table of claim 1 wherein said signature supporting plate is a generally planar surface with said first pair of drive belts at opposite edges thereof.

4. The binding line mail table of claim 1 wherein said first pair of drive belts are generally parallel lower belts and said second pair of drive belts are diverging upper belts.

5. The binding line mail table of claim 1 wherein said first pair of drive belts are generally flat and said second pair of drive belts are generally round in transverse cross-section.

6. The binding line mail table of claim 1 wherein said first and second pairs of drive belts are spaced apart at a signature entry end of said first and second pairs of drive belts.

7. A binding line mail table, comprising:

a plate for supporting a signature in a generally flat orientation as said signature is moved along said signature supporting plate, said signature supporting plate being generally planar and having opposed generally parallel outwardly and downwardly beveled edges;

a first pair of drive belts disposed on said signature supporting plate in spaced apart relation and a second pair of drive belts disposed on the respective ones of said first pair of drive belts on the sides opposite said signature supporting plate;

said first pair of drive belts being generally flat in transverse cross-section, being disposed in generally parallel relation at opposite edges of said signature supporting plate, and being adapted to be driven on said beveled edges thereof;

means for driving said drive belts at the same speed for moving said signature along said signature supporting plate;

at least one of said drive belts of one of said pairs diverging relative to the respective one of said drive belts of the other of said pairs so as to ensure that said signature is in said generally flat orientation as it moves along said signature supporting plate.

8. The binding line mail table of claim 7 wherein said first pair of drive belts are generally parallel lower belts and said second pair of drive belts are diverging upper belts.

9. The binding line mail table of claim 7 wherein said first pair of drive belts are generally flat and said second pair of drive belts are generally round in transverse cross-section.

10. The binding line mail table of claim 7 wherein said first and second pairs of drive belts are spaced apart at a signature entry end of said first and second pairs of drive belts.

11. The binding line mail table of claim 7 including means for printing on said signature as said signature is moved by said drive belts along said signature supporting plate.

12. The binding line mail table of claim 11 wherein said signature is moved relative to said signature printing means in a generally linear path along said signature supporting plate.

13. A binding line mail table, comprising:

a plate for supporting a signature in a generally flat orientation as said signature is moved along said signature supporting plate, said signature supporting plate being generally planar and having opposed generally parallel outwardly and downwardly beveled edges;

a first pair of drive belts disposed on said signature supporting plate in spaced apart relation and a second pair of drive belts disposed on the respective ones of said first pair of drive belts on the sides opposite said signature supporting plate;

said first pair of drive belts being generally flat in transverse cross-section, being disposed in generally parallel relation at opposite edges of said signature supporting plate, and being adapted to be driven on said beveled edges thereof;

said first pair of drive belts being generally parallel lower drive belts and said second pair of drive belts being diverging upper drive belts to ensure said signature is in said generally flat orientation as it moves along said signature supporting plate; means for driving said drive belts at the same speed for moving said signature along said signature supporting plate; and means for printing on said signature as said signature is moved by said drive belts along said signature supporting plate.

14. The binding line mail table of claim 13 wherein said first pair of drive belts are generally flat and said second pair of drive belts are generally round in transverse cross-section.

15. The binding line mail table of claim 13 wherein said first and second pairs of drive belts are spaced apart at a signature entry end of said first and second pairs of drive belts.

16. The binding line mail table of claim 13 wherein said signature is moved relative to said signature printing means in a generally linear path along said signature supporting plate.

* * * * *